US008128066B2

(12) United States Patent
Durrant

(10) Patent No.: US 8,128,066 B2
(45) Date of Patent: Mar. 6, 2012

(54) DOOR AND BOARD LIFTING DEVICE

(76) Inventor: Ian Durrant, Surrey (GB)

( * ) Notice: Subject to any disclaimer, the term of this patent is extended or adjusted under 35 U.S.C. 154(b) by 513 days.

(21) Appl. No.: 11/632,799

(22) PCT Filed: Jul. 21, 2005

(86) PCT No.: PCT/GB2005/002873

§ 371 (c)(1),
(2), (4) Date: Mar. 27, 2008

(87) PCT Pub. No.: WO2006/008536

PCT Pub. Date: Jan. 26, 2006

(65) Prior Publication Data

US 2008/0237557 A1 Oct. 2, 2008

(30) Foreign Application Priority Data

Jul. 21, 2004 (GB) ..... 0416290.5

(51) Int. Cl.
*B66F 3/00* (2006.01)

(52) U.S. Cl. ..... 254/131; 254/120

(58) Field of Classification Search ..... 254/131, 254/120, 8 R

See application file for complete search history.

(56) References Cited

U.S. PATENT DOCUMENTS

| | | | | | |
|---|---|---|---|---|---|
| 1,018,282 | A | * | 2/1912 | Warner | 254/120 |
| 1,266,788 | A | * | 5/1918 | Gannaway | 29/221 |
| RE30,533 | E | * | 3/1981 | Dushku | 254/113 |
| 4,712,771 | A | * | 12/1987 | Donnelly et al. | 254/131 |
| 5,814,842 | A | * | 9/1998 | Muldoon et al. | 254/131 |
| 6,022,008 | A | * | 2/2000 | Bachman | 269/37 |

FOREIGN PATENT DOCUMENTS

| | | | |
|---|---|---|---|
| DE | 93 12 875 | U1 | 11/1993 |
| EP | 1 316 470 | A | 6/2003 |
| GB | 2 225 769 | A | 6/1990 |

OTHER PUBLICATIONS

PCT/GB2005/002873 mailed Sep. 20, 2005.

* cited by examiner

*Primary Examiner* — Lee D Wilson
*Assistant Examiner* — Jamal Daniel
(74) *Attorney, Agent, or Firm* — Amster, Rothstein & Ebenstein LLP

(57) ABSTRACT

A door and board lifting device comprising a foot operated lever and locking means wherein said locking means is operative to releasably secure the lever in a substantially fixed position.

6 Claims, 1 Drawing Sheet

DOOR AND BOARD LIFTING DEVICE

This is a U.S. national phase of PCT Application No. PCT/GB2005/002873, filed Jul. 21, 2005, which claims priority to United Kingdom Application No. GB 0416290.5, filed Jul. 21, 2004.

The present invention relates to a door and board lifting device.

When fitting doors it is necessary to lift them such that the hinges may be screwed onto the door frame in the correct position. When a door is being fitted by a single person this can be tricky and an aid to lift the door may be necessary.

Existing aids include those with a lever attached to a base, however these are problematic in that the operator must attempt to maintain the door or board at the appropriate height with the lever whilst also working with the door or board, for example by securing it to a hinge.

The present invention seeks to address these issues.

According to the present invention there is provided a door and board lifting device comprising a foot operated lever and locking means wherein said locking means is operative to releasably secure the lever in a substantially fixed position.

Preferably the locking means is operative to releasable secure the lever at any point through the lever's movement.

Preferably the lever is pivotally connected to a base. In this arrangement the locking means is preferably operative to secure the lever in a substantially fixed position relative to the base.

Preferably said locking means incorporates an elongate rod with a main axis substantially in the direction of the lever's movement and a locking element frictionally engagable thereon.

Preferably said locking element is urged along the elongate rod by resilient biasing means when the lever is operated.

Preferably said resilient biasing means is a spring. More preferably said spring surrounds the elongate rod.

Preferably said locking element secures the lever by frictionally engaging with the elongate rod.

Preferably a release lever operative to release the locking means is provided.

Preferably the height of the fulcrum of the lever is adjustable.

Preferably the lever incorporates an elongate slot through which the elongate rod passes.

Preferably a washer is provided between the base of the spring and the lever.

In order that the invention may be more fully understood a specific embodiment will now be described, by way of example, with reference to the accompanying drawings, of which:

Figure 1:
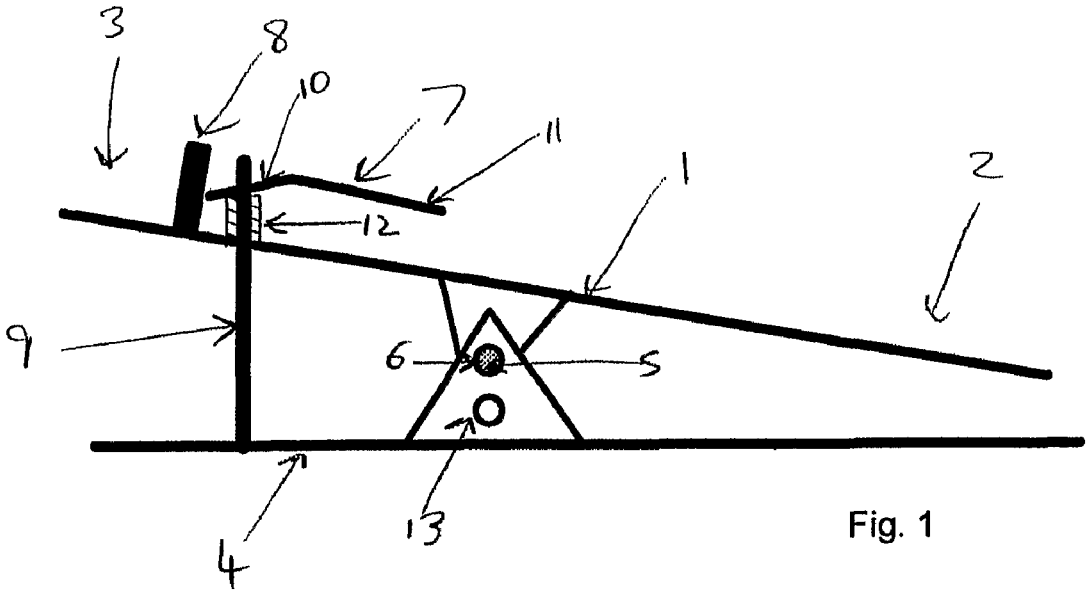
FIG. 1 is a schematic diagram of a side view of a door and board lifter made in accordance with the present invention.
Figure 2:
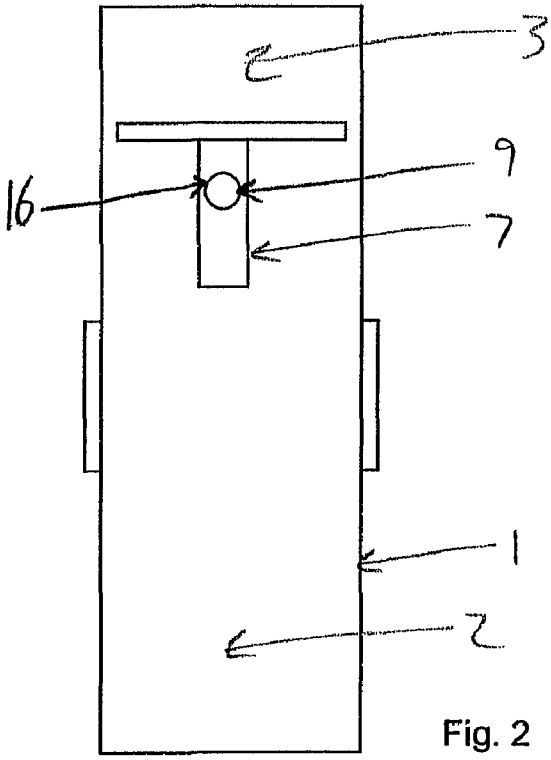
FIG. 2 is a schematic diagram of a plan view of the door and board lifter of FIG. 1.

Referring to the drawings, the door and board lifter comprises a lever 1, with a pedal area 2 and a lifting area 3. The lever is pivotally mounted on a base 4 by means of a screw 5 that passes through mounting hole 6. A locking element 7 is provided on elongate rod 9. The locking element is an angled strip of metal. The locking element is free from but engages with a stop 8 on the lever. The locking element may engage, for example, with a detent on the stop or pass into or through the stop. The locking element incorporates a substantially circular hole 16 through which elongate rod 9 passes. The elongate rod is mounted on the base. A spring 12 is provided between lever 1 and locking element 7.

The lever 1 is approximately 30 cm (12 inches) long by 11.5 cm (4½ inches) in width.

Locking element 7 may be considered to be divided into two sections, an engaging section 10 and a releasing section 11. When engaging section 10 is substantially orthogonal to elongate rod 9 the locking element is free to slide along the elongate rod. When engaging section 10 is at an angle to elongate rod 9 it frictionally engages with the elongate rod and is not free to slide.

Figure 3:
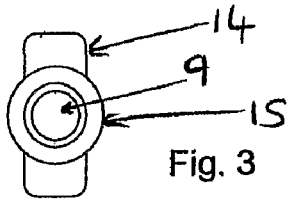
FIG. 3 is a schematic diagram of the elongate slot in the lever.

Lever 1 also incorporates a slot 14 through which elongate rod 9 passes. This slote is elongate such that as the lever is free to pivot. A washer 15 is provided at the base of spring 12. This arrangement, with the exception of spring 12 may be seen in FIG. 3.

A second mounting hole 13 is provided in the base 4 such that the lever may be attached to the base at a different height setting. When the lever is fixed at the top hole 6, the lever is able to move through a height of 9.5 cm (3¾ inches). When the lever is fixed in the bottom hole the lever will move through a height of 6.4 cm (2½ inches).

In use, the lever starts with the pedal area 2 in a raised position. A door or board is slid onto the lifting area 3 of the lever. By stepping on the pedal area the operator of the door or board lifter initiates pivoting of the lever around screw thereby lifting the door or board. As the lever pivots, the spring urges locking element 7 up the elongate rod 9. The locking element is free to move as its engaging section 10 is substantially orthogonal to the elongate rod. When the door or board has reached the height desired by the operator, they may remove pressure from the pedal area of the lever. This causes the lifting area 3 of the lever to move down under the weight of the door or board and the stop 8 to engage with the end of the engaging section 10 of locking element 7 such that engaging section 10 is angled downwards and the sides of the hole 16 through which elongate rod 9 passes frictionally grip the elongate rod. Thus the lever is now prevented from moving back to its initial position by stop 8 being caught on the end of locking element 7 allowing the operator to attend to fixing the door or board without trying to maintain pressure on the lever.

To release the fictional lock the operator simply applies pressure to the release section 11 of locking element 7. This restores locking element 7 to a position where engaging section 10 is substantially orthogonal to elongate rod 9 and removes the frictional grip such that the lever is free to move.

Door and board lifters made in accordance with the present invention have several advantages. They are easy to construct, simple to operate and may lift doors or boards to any appropriate height whereupon the locking means is activated and the operator is free to work with the door or board.

The above embodiment is described by way of example only. Many variations are possible without departing from the spirit of the invention.

The invention claimed is:

1. A door and board lifting device comprising a base, a foot operable lever pivotally mounted on the base to provide a fulcrum for the lever, and locking means for the lever;

the lever having a portion adjacent one end thereof upon which a door or board may be positioned for lifting thereof by rotation of the lever about a fulcrum in a first sense;

the locking means being operative to releasably secure the lever against rotation in a sense reverse to said first sense to lower a door or board lifted by said lever, and the locking means incorporating a rod and a locking element adapted for engagement both with the rod and with the lever to secure the lever against rotation in said reverse sense at any point through the lever's movement, the rod being fixedly mounted in upstanding position on the base, the rod having a distal end remote from the base, and the locking element being urged towards said distal end by resilient biasing means when the lever is rotated in said first sense, the locking element defining a hole through which the rod may freely pass when the locking element is orthogonal to the rod, and sides of which hole being adapted frictionally to grip the rod when the locking element is misaligned to a predetermined extent from orthogonality with the rod.

2. The device of claim 1, wherein the locking element is adapted to serve as a release lever, when the lever is secured by said locking means, by engagement of the locking element by a user for movement of said locking element towards orthogonality with said rod to release the locking means to allow rotation of the lever in said reverse sense.

3. The device of claim 1 wherein the resilient biasing means is a spring.

4. The device of claim 3, wherein the spring surrounds the rod.

5. The device of claim 4, wherein the lever incorporates an elongate slot through which the rod extends, the spring has a first end and a second end, a washer is provided between the first end of the spring and the lever, and the second end of the spring engages the locking element.

6. A method of lifting a door or board, comprising the steps of:

placing a horizontal edge of the door or board on one end of a lever having a fulcrum between the said one end and a second end;

stepping on said second end to rotate the lever in a first sense to raise the door or board while manually supporting vertical side edges of the door or board;

releasing pressure on said second end to cause a locking means automatically to engage the lever to secure it against rotation in a sense reverse to said first sense thereby maintaining the one end of the lever in a raised condition, the locking means incorporating a rod and a locking element that engages both with the rod and with the lever upon said release of pressure to secure the lever against rotation in said reverse sense at any point through the lever's movement, the rod being fixedly mounted in upstanding position on a base, the rod having a distal end remote from the base, and the locking element being urged towards said distal end by resilient biasing means when the lever is rotated in said first sense, the locking element defining a hole through which the rod may freely pass when the locking element is orthogonal to the rod, and sides of which hole being adapted frictionally to grip the rod when the locking element is misaligned to a predetermined extent from orthogonality with the rod.

* * * * *